United States Patent [19]

Maddox

[11] Patent Number: 4,756,384

[45] Date of Patent: Jul. 12, 1988

[54] COLLAPSIBLE SUPPORT

[76] Inventor: Al Maddox, P.O. Box 20 B, South Miami, Fla. 33143

[21] Appl. No.: 116,573

[22] Filed: Nov. 4, 1987

[51] Int. Cl.[4] ..... B27B 21/00; E01F 13/00

[52] U.S. Cl. ..... 182/18; 182/129; 182/184; 182/185; 116/63 P

[58] Field of Search ..... 182/181–186, 182/224, 225, 151, 18, 129; 116/63 P

[56] References Cited

U.S. PATENT DOCUMENTS

| | | | |
|---|---|---|---|
| 488,349 | 12/1892 | Bradley | 182/185 |
| 1,103,699 | 7/1914 | South | 182/184 |
| 1,458,738 | 6/1923 | Teeken | 182/181 |
| 1,576,583 | 3/1926 | England | 182/183 |
| 1,765,685 | 6/1930 | Mansfield | 182/185 |
| 2,325,592 | 8/1943 | Degler | 182/183 |
| 2,435,060 | 1/1948 | Thompson | 182/184 |
| 2,711,917 | 6/1955 | Blu | 182/185 |
| 3,380,429 | 4/1968 | Moinicken | 116/63 D |
| 4,104,980 | 8/1978 | Toomey | 116/63 P |
| 4,596,308 | 6/1986 | Auerbach | 182/151 |

*Primary Examiner*—Reinaldo P. Machado
*Attorney, Agent, or Firm*—Lewis A. Thaxton

[57] ABSTRACT

A collapsible support is provided for supporting carpentry work, boards, roadside annunciators and the like. The support is equipped with downwardly divergent and telescoping legs, for height adjustment, that are united to a horizontal beam or stringer by means of 3-way brackets. A pair of leg braces are provided to limit leg spread, afford additional support to each pair of legs and also support a carrying case. When the support apparatus of this invention is disassembled it may be positioned inside the carrying case for compact storage or transporting about.

5 Claims, 5 Drawing Sheets

COLLAPSIBLE SUPPORT

BACKGROUND OF THE INVENTION

This invention relates to sawhorse-type of supports and more particularly to supports that are light weight and collapsible in design.

Such supports are frequently used by painter, carpenters, bricklayers and other workers for various reasons. Most ordinary, are the sawhorse-type of supports of rigid construction and well-adapted for work supporting uses. A major drawback for these conventional type of supports is that they are awkward to store and transport since they require so much space.

Responding to this drawback of conventional supports, has been the proposals for knock-down or collapsible supports which may be disassembled for storage and/or transporting as set forth in U.S. Pat. No. 1,103,699, issued to W. South on July 14, 1914. This patent discloses a sawhorse having a horizontally foldable member with a plurality of folding legs. South's sawhorse may be readily stored and transported. J. England, in U.S. Pat. No. 1,576,583 and issuing on Mar. 16, 1926, disclosed a collapsible and extensible sawhorse that is also easily stored and transported.

Another disclosure of interest is found in U.S. Pat. No. 2,435,060, issued to P. Thomson on Jan. 27, 1948.

One of the disadvantages of the prior art collapsible sawhorse is that they fail to provide a sufficiently sturdy horizontal support structure.

Another disadvantage of prior art collapsible sawhorses is that they are unable to support as much weight as the conventional, non-collapsible sawhorse.

It therefore, is a general object of this invention to provide an improved collapsible, yet sturdy support.

Another object of the present invention is to provide a light weight support having an adjustable height means.

A further object of this invention is to provide an improved collapsible support which may be easily disassembled or assembled and when disassembled, stored in a commensurable carrying case.

Yet another object of this invention is to provide a support having a connector for extending the overall length thereof, as well as having means to detachably display various roadside signs.

Other objects and advantages of this invention will become more fully apparent as this description proceeds, with reference being made to the accompanying drawings and appended claims.

SUMMARY OF THE INVENTION

Accordingly, the present invention has been developed with a view toward providing a collapsible, yet light weight, support for receiving lateral members, such as boards and the like. The improved support comprises a horizontal stringer member supported by four downwardly divergent and adjustable legs. These adjustable legs are connected to the stringer member by means of two 3-way detachable/tubular brackets. Further, each pair of depending legs is supported, one to the other, with a cross-member. The cross members also support the unit carrying case, thus, providing a rest for tools and the like.

A better understanding of the subject invention will be enabled when the following written description is read in conjunction with the appended drawings in which.

DESCRIPTION OF THE PREFERRED EMBODIMENT

Figure 1:
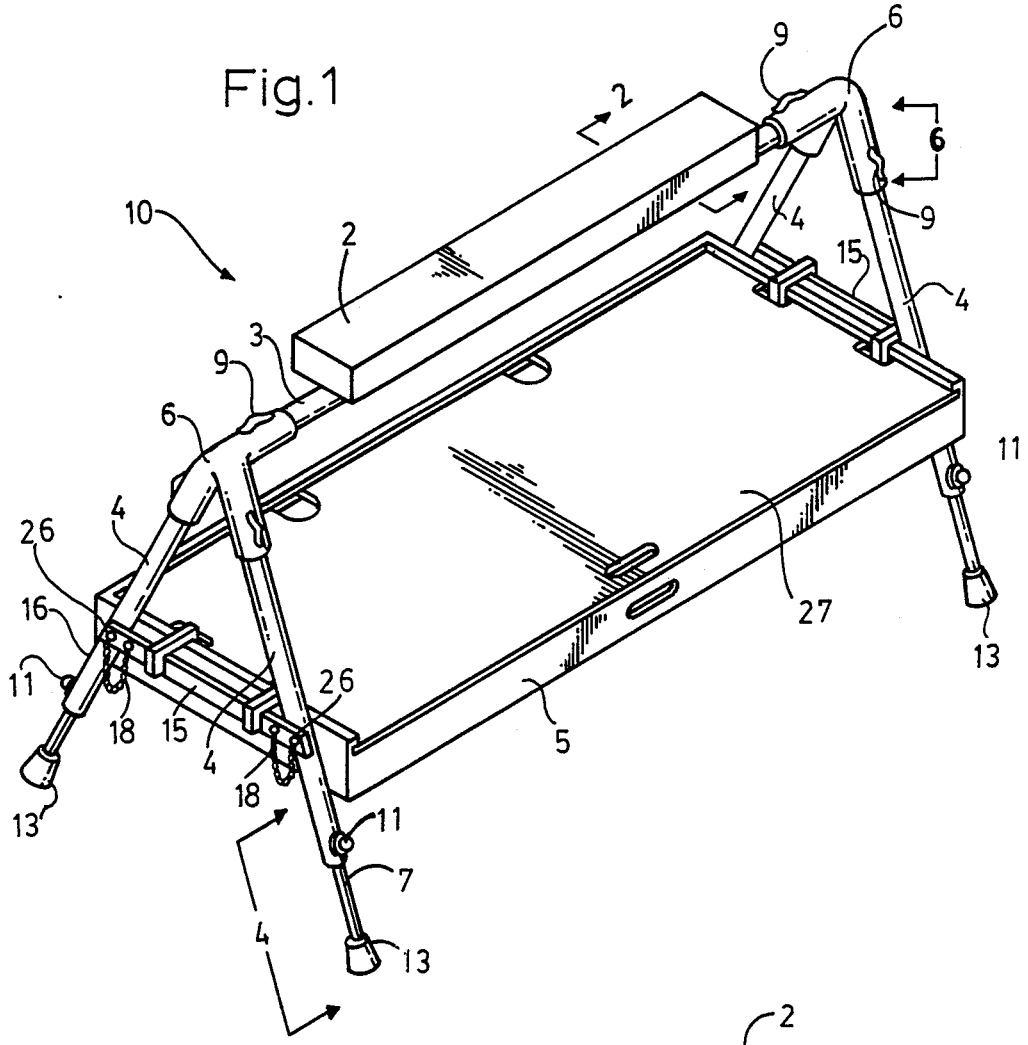
FIG. 1 is a perspective view of a collapsible support embodying the features of the present invention.

Referring now to the drawings, wherein like numerals refer to like parts throughout the several views, and in particular to FIG. 1, wherein there is illustrated a collapsible support 10 of this invention comprising, as major components, a work supporting beam 2, mounted to tubular member 3, a first pair of tubular legs 4, a second pair of tubular legs 4, bracket means 6 uniting tubular member 3 to each end, to a pair of tubular legs 4. Storage case 5 is intermediately positioned between each pair of legs 4 by means of brace 15.

Figure 2:
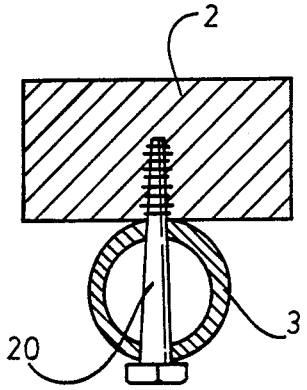
FIG. 2 is a cross-sectional view taken along line 2—2 of FIG. 1 showing details at attaching the horizontal support beam to the underlying tubular member.

The stringer comprises an elongate rectangular member 2 secured to tubular frame 3 via at least two screws 20, one of which is displayed in FIG. 2. Brackets 6 join legs 4 to the elongated tubular frame 3.

Figure 3:
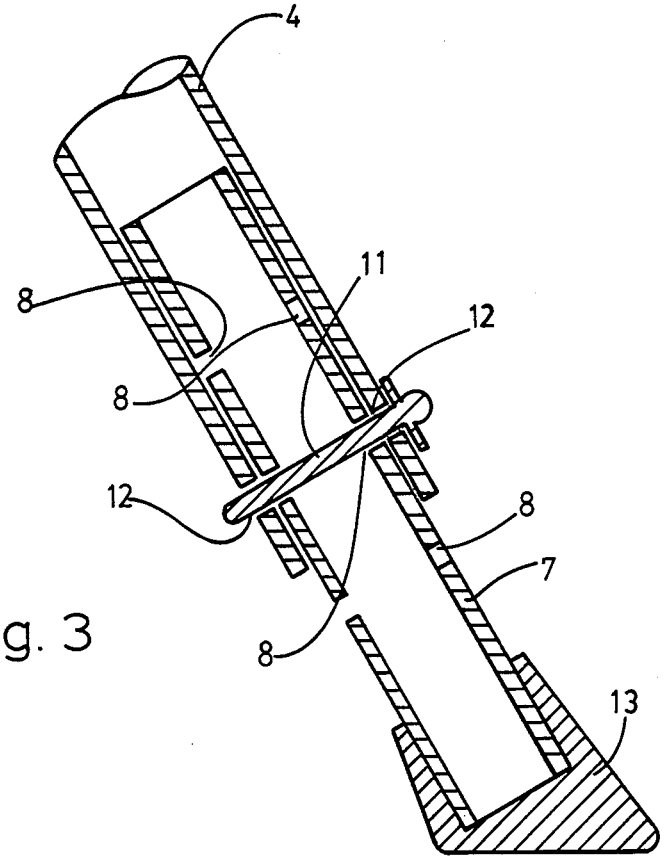
FIG. 3 is a cross-sectional and side elevational view taken along the line 4—4 of FIG. 1 showing details of an adjustable leg.

Now, referring to FIGS. 1 and 3, the legs 4 have inner disposed extension legs 7, which are adjustably secured in legs 4 so as to adjust the height of the support beam 2 as a whole. Suiting this purpose, telescoping legs 7 have a number of holes 8, any one of which may be aligned with a hole 12 in leg 4, admits a pin 11. Thus, the pin 11 extending through a single hole 12 in leg 4 and any one of plural holes in extension leg 7 locks the two together at a certain height, to carry the horizontal support beam 2. Holes 8 are incrementally spaced ten inches one from the other. Each of extension legs 7 has attached to its bottom end, a rubber cup disc 13 to provide stable anchoring of unit 10 to a surface beneath by increasing frictional contact therewith.

Figure 6:
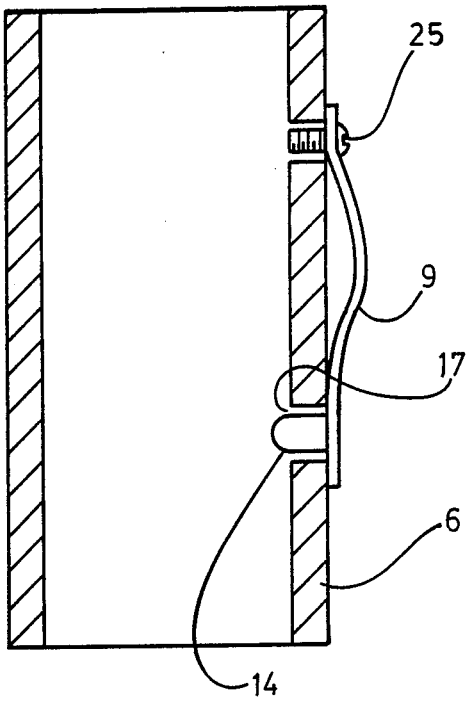
FIG. 6 is a cross-sectional view taken along line 6—6 of FIG. 1 showing details of a bracket fastening means.

As illustrated in FIG. 1, the top end of leg 4, having a hole therein (not shown), is positioned in an opening in a bracket 6 and is securely fastened in place by a biased-spring 9. Detailed in FIG. 6, biased-spring 9 has disposed at its bottom end, a nipple 14 depending on a hole 17, and attached to bracket 6 at the upper end by means of a screw 25. It should be noted then, that each of identical legs 4 may be snapped into position through the insertion of nipple 14 into hole 17 aligned with a hole (not shown) disposed at the upper end of legs 4. Similarly, tubular member 3, having located on its dorsal side and at each end, holes 19 for securing bracket 6 via mating with nipple 14 thereon.

Figure 5:
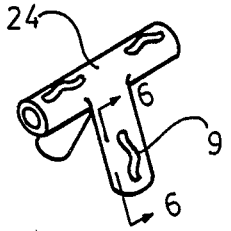
FIG. 5 is a perspective view of a 4-way bracket which may be used to connect a plurality of horizontal members or stringers to provide an extended support system.

An alternative embodiment to the use of bracket 6, is the use of 4-way bracket 26 shown in FIG. 5. As understood by one skilled in the art, bracket 26 enables an extension of the single support unit into multiple units of the same formation. Such extended supports are of interest to carpenters, painters, highway construction workers and the like.

Figure 4:
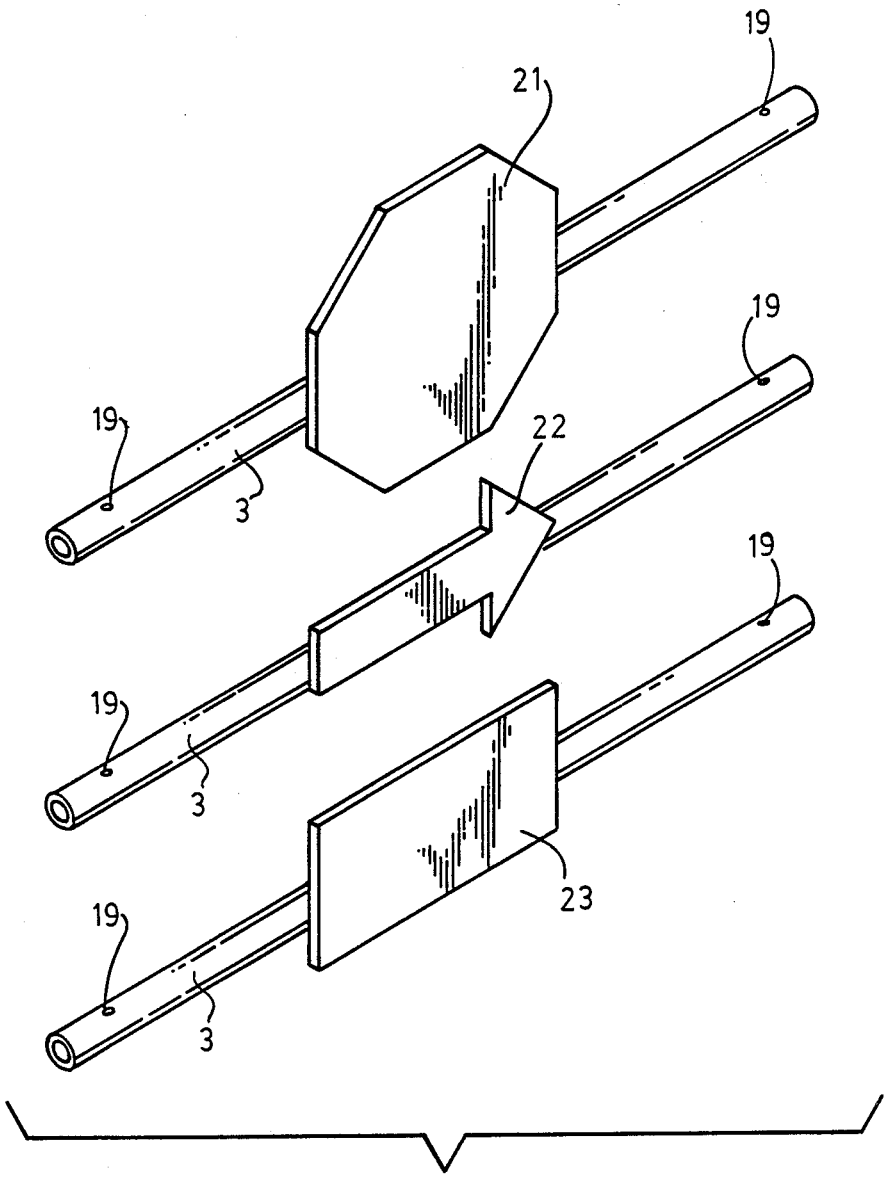
FIG. 4 is a perspective view illustrating three different roadside signs which may be substituted for the horizontal support stringer of FIG. 1.

An alternative embodiment to the use of support beam 2, is its replacement with roadside annunciators as shown in FIG. 4. Annunciator 21 is in the contour of a stop sign; annunciator 22 is in the design of a directional signal; while annunciator 23 provides a surface for receiving any suitable printed matter. It is appreciated that each of these indicators may be afforded a light reflecting means or may be equipped with a battery operated light.

Attention to FIG. 1, it is recognized that increased support coupled with the spread position of the legs is fixed by a rigid cross brace 15. These cross braces are attached to legs 4 by means of a pin 26 inserted into aligned holes positioned at the lateral end of each brace 15, each leg 4 and each telescoping leg 7. Two chains 18 are positioned near the end of each brace 15 to retain pins 26, for user convenience sake and obviating confusion with pins 11 when the unit is disassembled.

Figure 7:
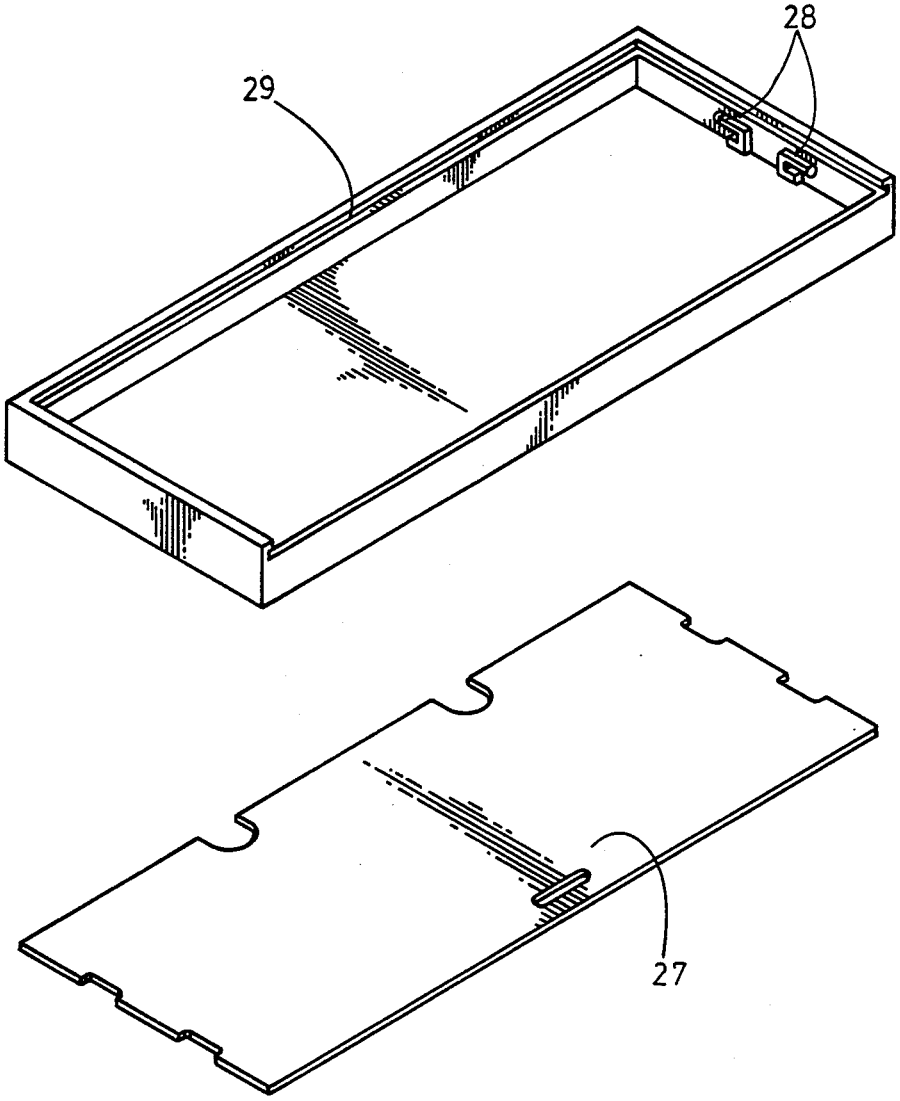
FIG. 7 is a perspective view of the support storage and carrying case shown in open position.

With reference to FIGS. 1 and 7, the support of this invention is provided with a convenient rectangular carrying case 5 and corresponding lid 27. Carrying and storage case 5 contains a groove 29 located on each upper lateral side and upper rear of the case. Appropriately notched lid 29 is slidably mounted within groove 29 to achieve enclosure of the inventive disassembled support. Carrying case 5 contains pivotal hooks 28 laterally disposed to latch over braces 15. When carrying case 5 is positioned as shown in FIG. 1, it may serve as a temporary shelf to hold assorted tools or miscellaneous items pertinent to the task at hand.

It is apparent that the new and improved inventive sawhorse type of support, described herein, is capable of being readily disassembled into its individual components for storage and transporting. Conversely, the artisan can appreciated that the support of this invention may be quickly assembled at some preferred site. Moreover, it is contemplated that production of the inventive support makes use of light weight plastic and thermoplastic materials, the technology, of which, is already available.

It will, of course, be understood that modifications of the present invention in its various aspects will be apparent to those skilled in the art, some being apparent only after study while others being a matter of routine design. The invention, therefore, should not be seen as rigidly confined to the particular construction and arrangement of parts herein illustrated and described, but embraces all such modified forms thereof as come within the scope of the appended claims.

I claim:

1. A collapsible support comprising a pair of generally 3-way tubular connecting brackets having each of three parts radiating outwardly from a focal pointwith each adjacent pair of radiating parts occupying a plane different from the plane occupied by any two other parts, spring biased fastening means located adjacent the open end of each bracket part, four tubular leg members detachably secured at their top end to four connector parts by means of said spring biased fastening member, a single tubular stringer detachably connected at each of its ends to the remaining bracket connector, said stringer having means located along its length and spaced from each of its end portions to secure and support another member thereto, a brace extending between the tubular legs being detachably connected intermediately between the top positioned brackets and bottom situated surface, each tubular leg containing at its inner portion a telescopically projecting member that emerges at the bottom of each tubular leg, and each telescoping member contains a plurality of equally spaced holes any one of which is positioned in pin alignment with a corresponding hole in said tubular leg to provide a height adjustable support, and secured by hooks to the tubular leg braces a rectangular carrying case for the disassembled support.

2. The collapsible support of claim 1, wherein the 3-way connecting bracket's spring-biased means comprises an elongated leaf spring attached by a screw to the bracket at a top end and having a protruding nipple disposed at the opposite end thereof, said nipple being of a dimension that allows it to project through a pair of aligned holes in each tubular leg to thereby secure said leg to the bracket.

3. The collapsible support of claim 1, wherein the detachably connected tubular stringer is a roadside annunciator selected from the group consisting of a stop sign structure, a directional signal or a sign bearing printed indicia.

4. The collapsible support of claim 1, wherein each telescoping leg member contains a cup-shaped disc at its bottom end.

5. The collapsible support of claim 1, wherein the rectangular carrying case is attached to the leg braces by means of pivot pins and the case, so positioned, is employed as a retainer shelf for work tools.

* * * * *